US005944095A

United States Patent [19]

Fukuoka et al.

[11] Patent Number: 5,944,095

[45] Date of Patent: Aug. 31, 1999

[54] HEAT EXCHANGER

[75] Inventors: Mikio Fukuoka, Bisai; Yoshifumi Aki, Kariya; Naoki Sugimoto, Anjo, all of Japan

[73] Assignee: Denso Corporation, Kariya, Japan

[21] Appl. No.: 08/954,959

[22] Filed: Oct. 21, 1997

[30] Foreign Application Priority Data

Oct. 23, 1996 [JP] Japan ..... 8-280734

[51] Int. Cl.[6] ..... F28F 9/02

[52] U.S. Cl. ..... 165/173; 165/149; 165/175

[58] Field of Search ..... 165/173, 149, 165/175

[56] References Cited

U.S. PATENT DOCUMENTS

| | | | |
|---|---|---|---|
| 3,113,615 | 12/1963 | Huggins | 165/149 |
| 3,275,070 | 9/1966 | Beatenbough et al. | 165/175 |
| 4,119,144 | 10/1978 | Kun | 165/175 |
| 4,331,201 | 5/1982 | Hesse | 165/173 |
| 4,461,348 | 7/1984 | Toge et al. | 165/173 |
| 4,649,628 | 3/1987 | Allemandou | 165/173 |
| 4,739,918 | 4/1988 | Stokes et al. . | |
| 5,172,761 | 12/1992 | Lyon | 165/173 |
| 5,195,579 | 3/1993 | Buchanan | 165/149 |
| 5,311,933 | 5/1994 | Lee | 165/173 |
| 5,390,733 | 2/1995 | Young | 165/173 |

FOREIGN PATENT DOCUMENTS

| | | | |
|---|---|---|---|
| 0 145 574 A2 | 6/1985 | European Pat. Off. . | |
| 0 676 607 A1 | 10/1995 | European Pat. Off. . | |
| 0 718 580 A1 | 6/1996 | European Pat. Off. . | |
| 0718 580 A1 | 6/1996 | European Pat. Off. . | |
| 2 273 253 | 12/1975 | France . | |
| 2703-528 | 8/1978 | France | 165/173 |
| 2528-561 | 12/1983 | France | 165/173 |
| 4243495 | 6/1994 | Germany | 165/175 |
| 3-225197 | 10/1991 | Japan | 165/149 |
| 4-270895 | 9/1992 | Japan | 165/149 |
| 5-157484 | 6/1993 | Japan | 165/149 |
| 914539 | 1/1963 | United Kingdom | 165/149 |

*Primary Examiner*—Ira S. Lazarus
*Assistant Examiner*—Terrell McKinnon
*Attorney, Agent, or Firm*—Harness, Dickey & Pierce, PLC

[57] ABSTRACT

A heat exchanger includes a tank and a base plate, and each of the tank and the base plate is formed in a box shape having a U-shaped cross-section. The tank is connected to the base plate to close an end portion of an opening side of the tank using the base plate. Protrusion portions are provided inside a folded portion of the base plate in a lateral direction to be opposite to connection portions of first and second folded portions of the tank. Further, ribs are provided in the folded portion of the base plate in the lateral direction to increase stiffness of the base plate in a longitudinal direction thereof. Thus, connection portions of the tank and the base plate can be securely brazed.

12 Claims, 7 Drawing Sheets

HEAT EXCHANGER

CROSS-REFERENCE TO RELATED APPLICATION

This application is related to and claims priority from Japanese Patent Application No. 8-280734 filed on Oct. 23, 1996, the contents of which are hereby incorporated by reference.

BACKGROUND OF THE INVENTION

1. Field of the Invention

The present invention relates to a heat exchanger which is preferably used for a heater core or the like for an automotive air conditioning device, and more particularly relative to a tank and a base plate connected to the tank.

2. Description of Related Art

Conventionally, inventors of the present invention have proposed a heat exchanger, as disclosed in JP-A-8-226786 (EP 0718580 A1), to manufacture the heat exchanger in a low cost and to reduce the number of assembling steps. The heat exchanger includes a tank 1 and base plate 2 as shown in FIG. 10. In the heat exchanger, unfolded metal plates are respectively folded and the folded portions are connected to each other to form the tank 1 and the base plate 2. However, in the heat exchanger, connection surfaces are formed at folded portions of the tank 1 to ensure a connection area to be brazed. When the base plate 2 is connected to an opened end portion of the tank 1, a clearance 51 is formed in an connection potion A as shown in FIG. 11. Further, a claw portion 3 for receiving an insert plate for holding a core portion of the heat exchanger is provided on a folded portion of the base plate 2 in lateral direction (i.e., a short side portion) as shown in FIG. 10. Since a brazing material is clad on the core portion before brazing, the insert plate may extend outwardly in a longitudinal direction of the base plate so that the claw portion 3 may extend outwardly in the longitudinal direction of the base plate. Therefore, the folded portion of the base plate in the lateral direction also extends outwardly in the longitudinal direction of the base plate 2 so that the clearance 51 shown in FIG. 11 is further enlarged. Thus, the tank 1 and the base plate 2 cannot be securely connected and brazed to each other.

SUMMARY OF THE INVENTION

In view of the foregoing problems, it is an object of the present invention to provide a heat exchanger in which a tank and a base plate are securely connected and brazed to each other sufficiently.

According to the present invention, a protrusion protrudes from an inner wall of the base plate to be opposite to a connection portion between folded portions of the tank. Therefore, a clearance formed between an outside of the connection portion of the folded portions of the tank and an inside of the base plate is greatly decreased to securely braze a joined portion between the tube and base plate.

Preferably, a rib for increasing stiffness of the base plate in a longitudinal direction is provided in a claw portion formed on a folded portion of the base plate in the lateral direction. Therefore, even if a force extending outwardly in a longitudinal direction of the base plate is applied to the base plate before brazing, the folded portion of the base plate is not bent outwardly by forming the rib. Thus, the clearance between the tube and the base plate is not enlarged in assembling process of the heat exchanger, and a brazing between the tube and the base plate can be securely performed.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

A preferred embodiment of the present invention will described hereinafter with reference to the accompanying drawings.

Figure 1:
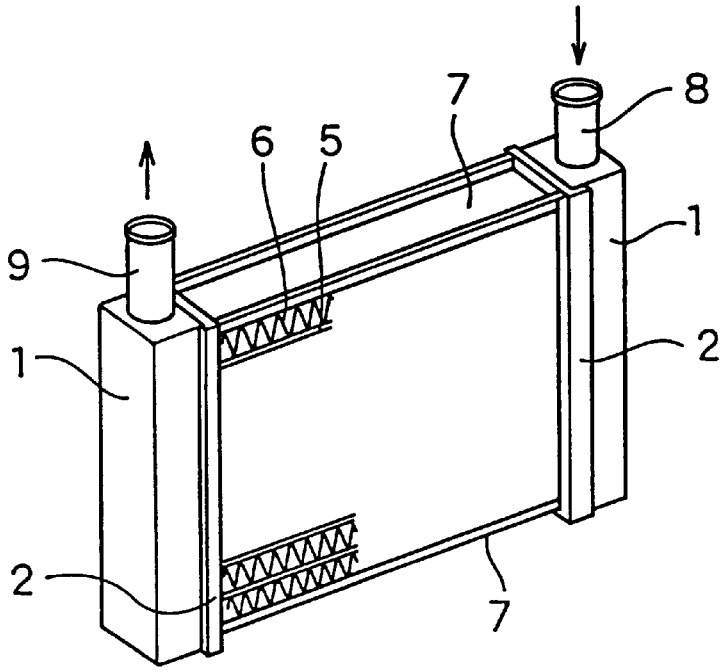
FIG. 1 is a perspective view showing a heat, exchanger according to a preferred embodiment of the present invention.

As shown in FIG. 1, a heat exchanger includes a tank 1 formed in a U-shape in a cross-section thereof and a base plate 2 connected to an opening end portion of the tank 1. The base plate 2 is also formed in a U-shape in a cross-section thereof. A plurality of tube receiving holes 4 are provided on the base plate 2 in such a manner that a longitudinal direction of the flat holes 4 for receiving the tubes is parallel to a lateral direction of the base plate 2.

A cross-section of a flat tube 5 is formed in a flat shape, and each end portion of the flat tube 5 is inserted into and joined with the tube receiving holes 4 of the base plate 2. A plurality of corrugated fins 6 are formed in a wavy shape and are disposed between the flat tubes 5 to be joined with the flat tubes 5. Both insert plates 7 are respectively disposed at both side portions of a core portion (i.e., heat exchanging portion) having the flat tubes 5 and the corrugated fins 6 and are connected to the base plates 2 and the corrugated fins 6.

An inlet pipe 8 for warm water (e.g., engine cooling water) is inserted into and connected to a, hole (not shown) provided at the tank 1. An outlet pipe 9 for cooled water (e.g., engine cooling water) is inserted into and connected to a hole (not shown) provided at the tank 1. Since a structure of the heat exchanger in FIG. 1 is a symmetrical structure with respective to the left and right direction, the positions of inlet pipe 8 and the outlet pipe 9 may be changed.

In this embodiment, the heater core shown in FIG. 1 is structured by an aluminum heat exchanger integrally connected by brazing. Although the corrugated fins 6, the inlet pipe 8 and the outlet pipe 9 are made of aluminum bare material in which a brazing material is not clad, other materials (1, 2, 5 and 7) are made of an aluminum clad material in which a brazing material is clad at both sides of the aluminum core material.

Figure 2:
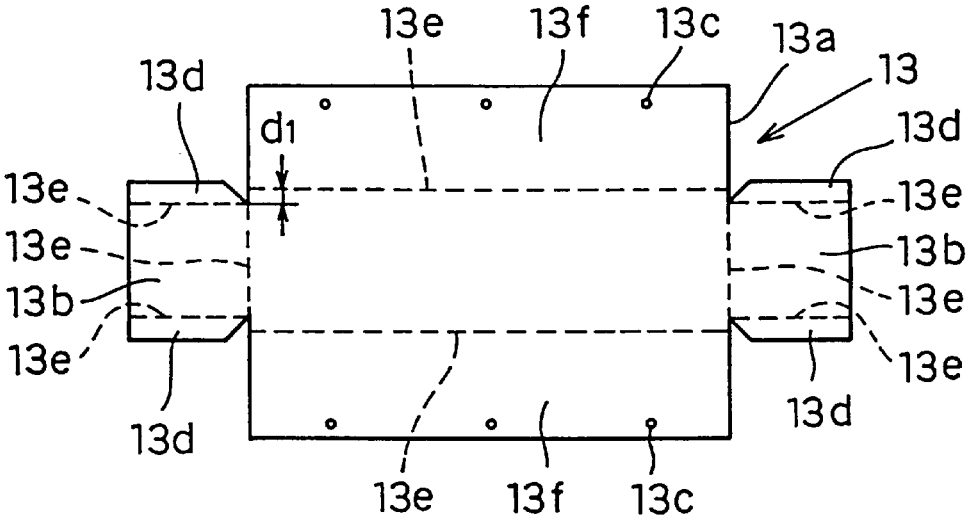
FIG. 2 is a plan view showing a metal plate forming a tank of the heat exchanger shown in FIG. 1.

FIG. 2 shows an unfolded state of a metal plate forming the tank 1. An unfolded metal plate 13 has a rectangular body portion 13*a*, and first folded portions 13*f* are formed in the body portion 13 along a long side portion thereof. Further, second folded portions 13*b* protruding from short side portions of the body portion 13*a* are formed. A plurality of semicircular protrusions 13*c* are formed proximate to long ends of body portion 13*a*. Connection surfaces 13*d* for ensuring brazing by increasing a connection area to be brazed are formed at both outer edge portions formed in a vertical direction of the second folded portions 13*b*.

Figure 3:
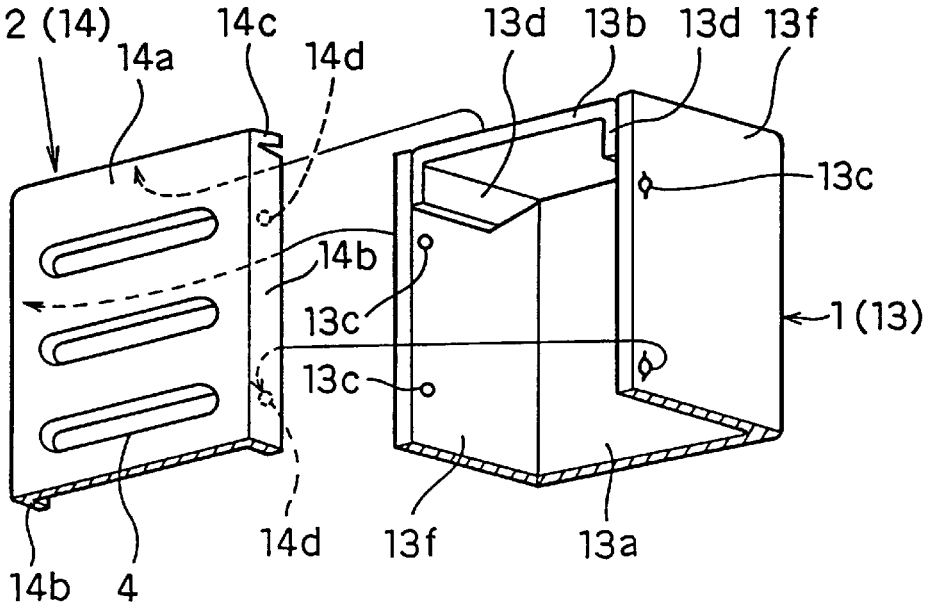
FIG. 3 is an exploded view showing an assembly of the tank and a base plate in FIG. 1.

After a flat metal plate is cut into an unfolded shape shown in FIG. 2 by a pressing process, the unfolded metal plate 13 for the tank 1 is formed in a tank shape shown FIG. 3, that is, a tank shape (i.e., box shape) having a U-shaped cross section. As shown in FIGS. 2 and 3, by folding the first and second folded portions 13*f* and 13*b* and the connection surface 13*d* at a ridgeline 13*e* shown with dotted lines in FIG. 2, the tank where one end side is opened and another end side is closed is formed.

The connection surfaces 13*d* of the second folded portions 13*b* contact inner surfaces of the first folded portions 13*f* to increase the brazing area therebetween. Therefore, the ridgeline 13*e* of the first folded portion 13*f* is offset outwardly from the ridgeline 13*e* of the connection surface 13*d* by a plate thickness d1 of the unfolded metal plate 13.

Figure 4:
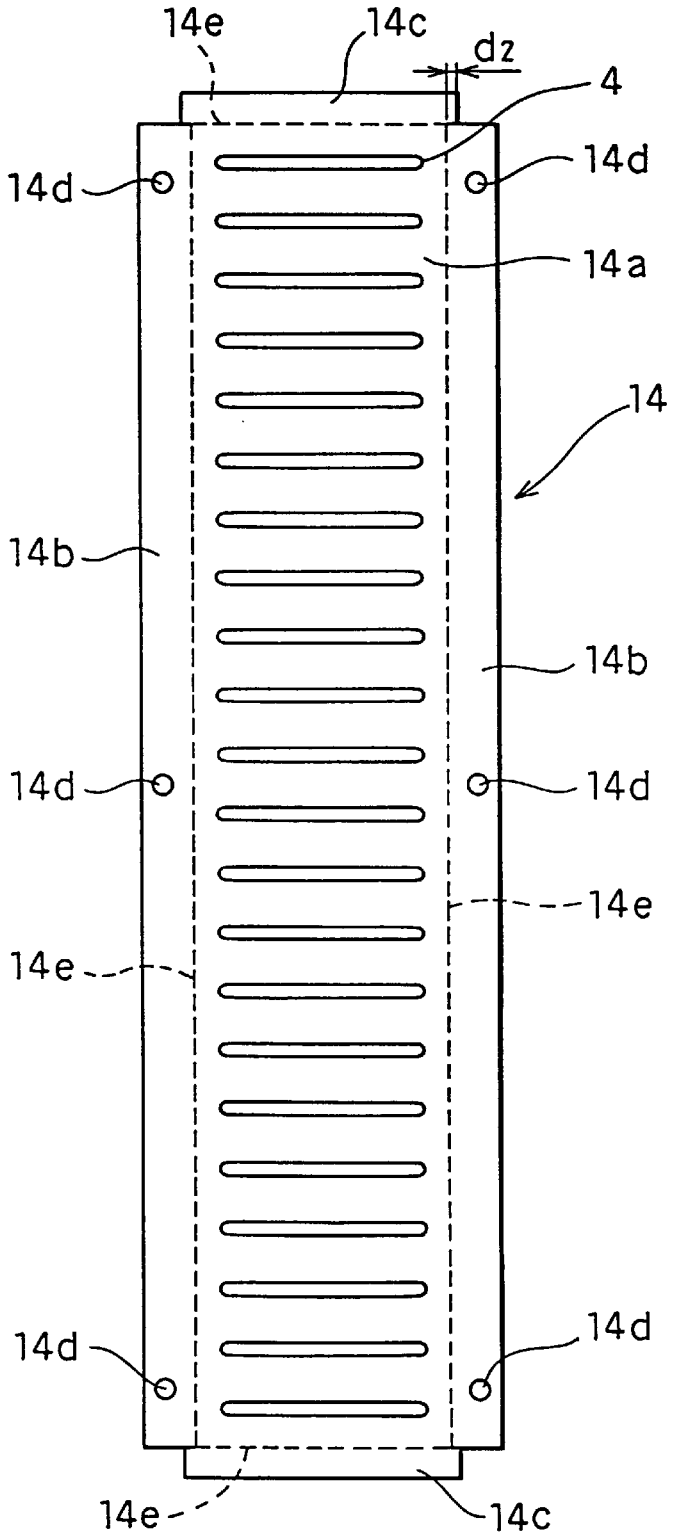
FIG. 4 is a plan view showing a metal plate forming the base plate in FIG. 1.

As shown in FIG. 4, an unfolded metal plate 14 for the base plate has the same shape as the unfolded metal plate 13 for the tank. The unfolded metal plate 14 includes a rectangular body portion 14*a*, first folded portions 14*b* and second folded portions. The first folded portions 14*b* are formed along a long side portion of the body portion 14*a*, and the second folded portions 14*c* are formed to protrude from short side portions of the body portion 14*a*.

A plurality of semicircular concave portions are formed on the first folded portions 14*b* of the body portion 14*a* to correspond to the semicircular protrusions 13*c* of the unfolded metal plate 13. In FIG. 4, a dotted line 14*e* illustrates a ridgeline as a folding position of the first and second folded portions 14*b* and 14*c*. End portions in the longitudinal direction of the second folded portion 14*c* are offset outwardly from the dotted line 14*e* of the first folded portions 14*b* by a plate thickness d2 of the unfolded metal plate 14. Therefore, after folding the first and the second folded portions 14*b* and 14*c*, the second folded portions 14*c* can be folded on end surfaces of the first folded portions (see FIG. 3). Thus, the second folded portions 14*c* can be securely brazed on the end surfaces of the first folded portions 14*b*.

After cutting the metal plate 14 into the unfolded shape in FIG. 4 by a pressing process, the first and second folded portions 14*b* and 14*c* are folded along the dotted line 14*e* so that the metal plate 14 is formed in a shape shown in FIG. 3, i.e., a box shape in which one end side is closed and another end side is opened. Since the second folded portions 14*c* are folded on the end surfaces of the first folded portions 14*b*, a brazing area between the first and second folded portions 14*b* and 14*c* is increased to sufficiently braze therebetween.

As shown in FIG. 3, the tank 1 and the base plate 2 are assembled in such a manner that the first and second folded portions 13*f* and 13*b* of the tank are inserted into inner peripheral sides of the first and second folded portions 14*b* and 14*c* of the base plate 2. At this time, by fitting the semicircular protrusions 13*c* of the tank 1 into the semicircular concave portions 14*c* of the base plate 2, an assembled state of the tank 1 and the base plate 2 can be maintained to prevent the tank 1 and the base plate 2 from being separated after being assembled together.

Next, a main portion of the heat exchanger of the present invention will be described with reference to FIGS. 5 through 9.

Figure 5:
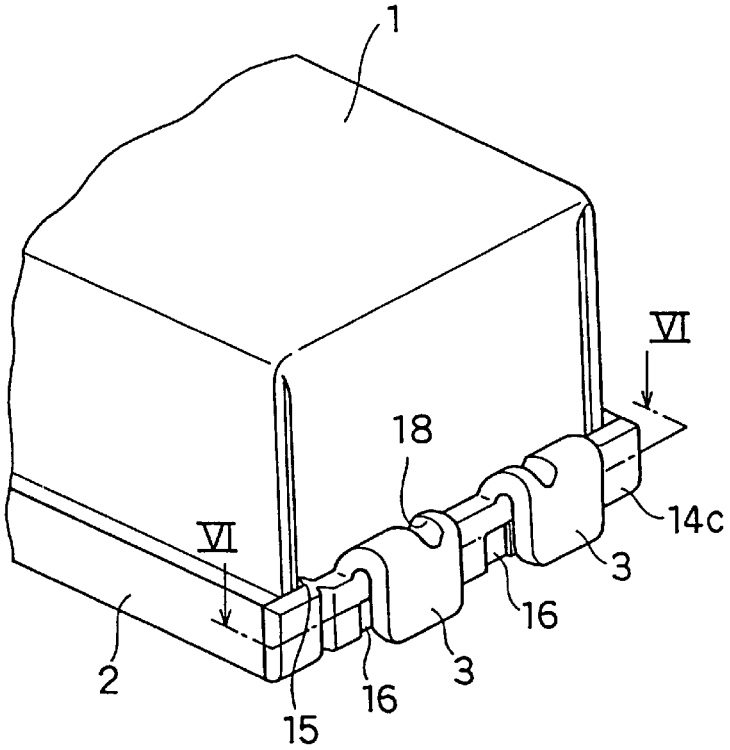
FIG. 5 is a perspective view showing a connection state of the tank and the base plate according to the first embodiment.
Figure 6:
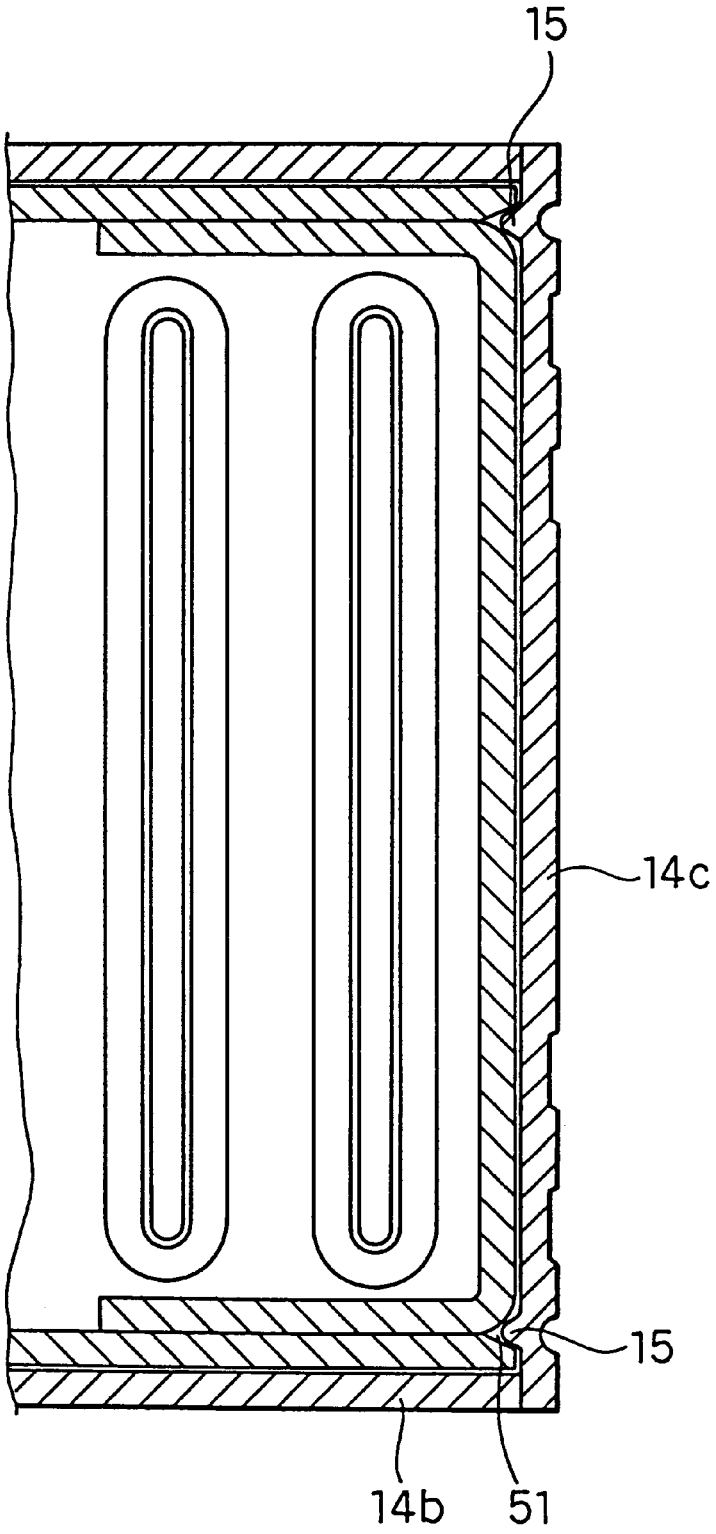
FIG. 6 is a cross-sectional view taken along line VI—VI in FIG. 5.
Figure 7:
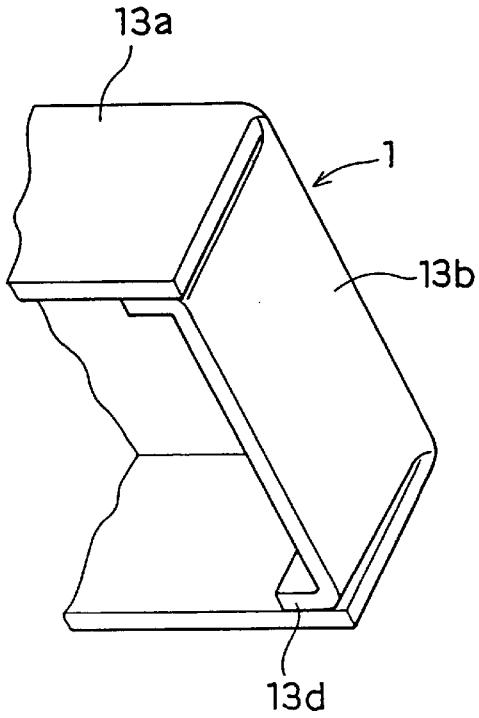
FIG. 7 is a perspective view showing the tank when viewed from an inside of the tank in FIG. 1.
Figure 10:
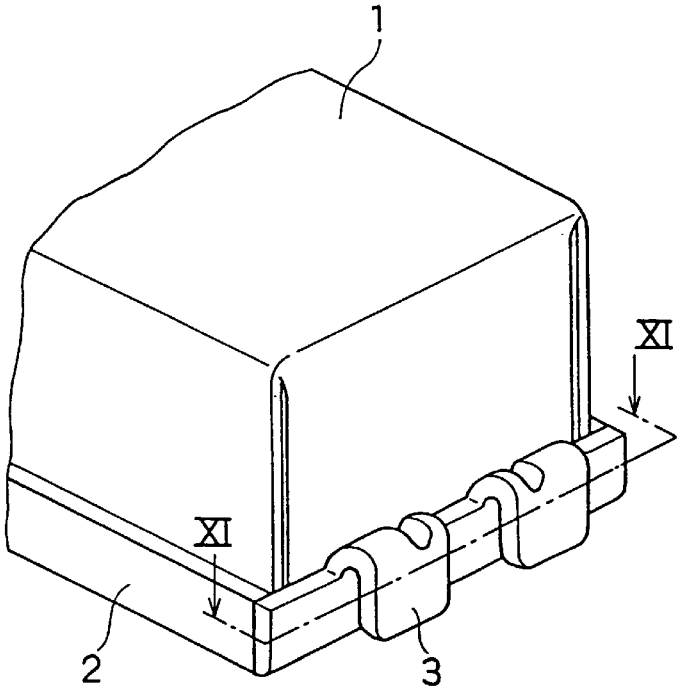
FIG. 10 RELATED ART
FIG. 10 a perspective view showing a conventional connection state of a tank and a base plate.
Figure 8:
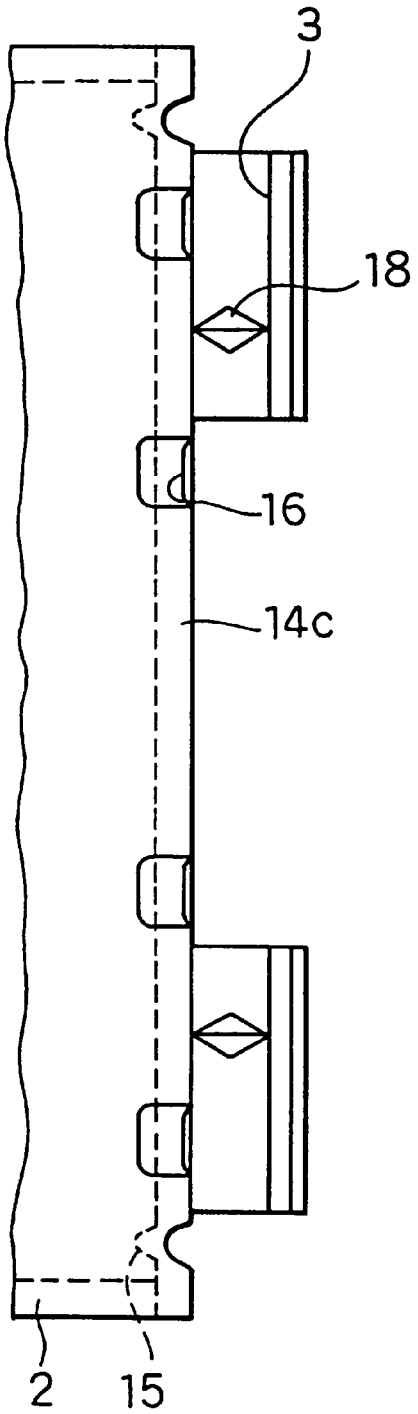
FIG. 8 is a bottom view showing the base plate in FIG. 5.

As shown in FIGS. 5 and 6, protrusion portions 15 are formed inside the second folded portions 14*c* of the base plate 2, and the protrusion portions 15 protrude from the second folded portions 14*c* of the base plate 2 to be opposite to a position where the first and second folded portions 13*f* and 13*b* are connected to each other. The protrusion portions 15 are formed by an ironing process at the same time as the folding step of the base plate 2. By the protrusion portions 15, clearances formed at connection portions between the first and second folded portions 13*f* and 13*b* of the tank 1 are filled. Therefore, a brazing between the tank 1 and the base metal 2 can be securely performed.

Figure 11:
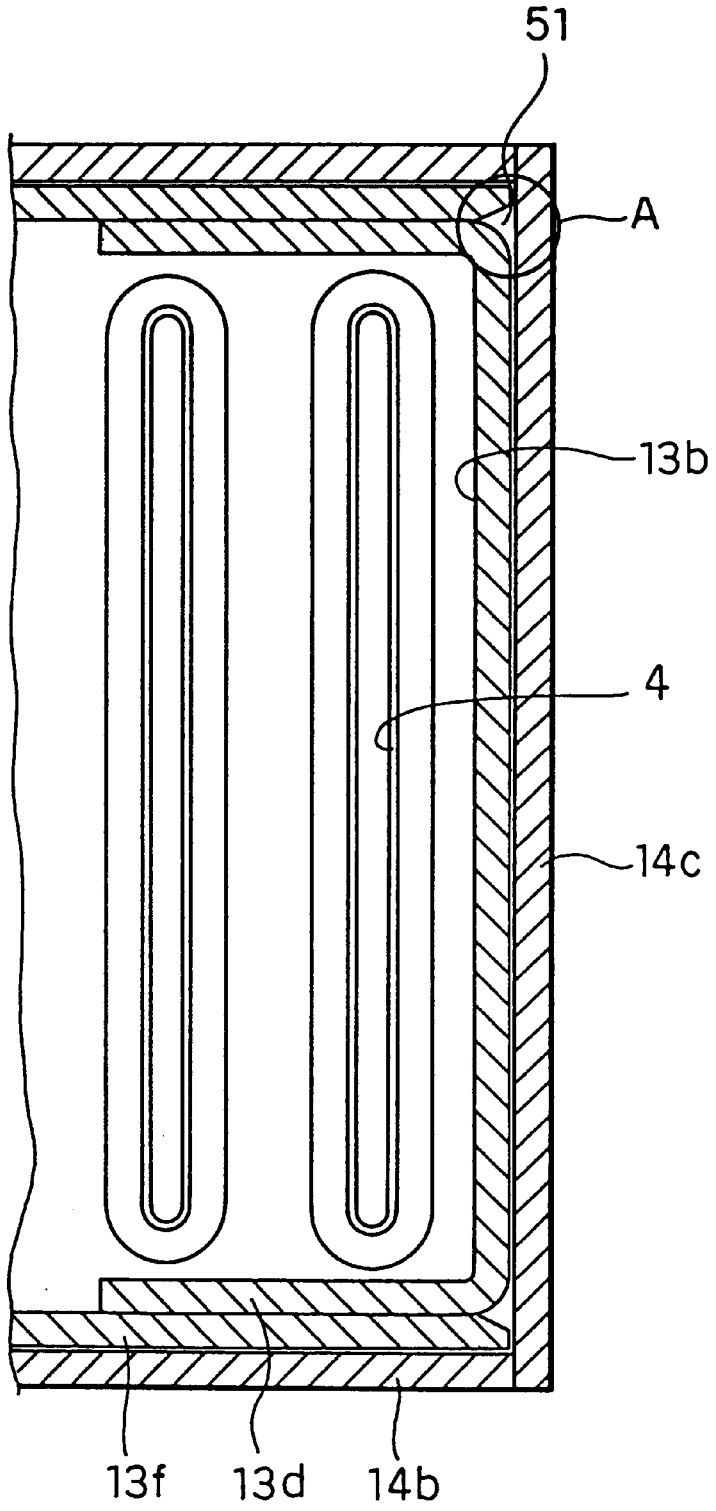
FIG. 11 RELATED ART
FIG. 11 is a cross-sectional view taken along line XI—XI in FIG. 10.

Further, four concave portions are formed in the second folded portion 14 of the base plate 2 to form four ribs 16. By the ribs 16, a rigidity of the base plate 2 in the longitudinal direction thereof can be improved. Even if the insert plate 7 is inserted into the claw portions 3 so that the insert plate 7 extends outwardly in the longitudinal direction of the tube 1 before brazing, the second folded portion 14*c* of the base plate 2 is not bent outwardly by forming the ribs 16 due to the concave portions. Thus, in this embodiment, the clearances 51 (see FIG. 11) formed at a connection portion between the first and second folded portions 13*f* and 13*b* of the tank 1 is not further enlarged. Therefore, a brazing between the tank 1 and the base metal 2 can be securely performed. The ribs 16 due to the concave portions are formed by a coining process or a press process in an unfolded metal plate before folding the base plate 2.

Figure 9:
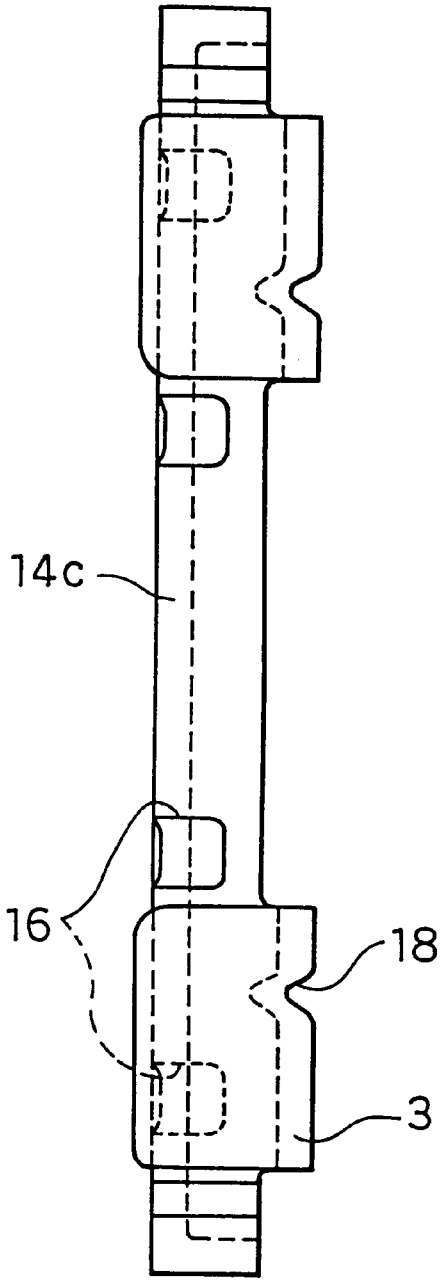
FIG. 9 is a side view showing the base plate in FIG. 5.

Further, as shown in FIG. 9, the claw portions 3 for receiving the insert plate 7 are formed on the second folded portion 14 of the base plate 2, and a concave portion 18 is formed in each claw portion 3. By the concave portions 18, the rigidity of the claw portion 3 is increased, and the insert plate 7 is accurately set to prevent the insert plate 7 from being shifted in the lateral direction of the tank 1 when the insert plate 7 is inserted into the claw portions 3. In this case, small holes are formed at an end portion of the insert plate 7 to engage with the convex portions 18.

Although the present invention has been fully described in connection with preferred embodiments thereof with reference to the accompanying drawings, it is to be noted that various changes and modifications will become apparent to those skilled in the art.

For example, in the first embodiment, on the connection surface of the tank 1 and base plate 2, the connection surface is provided in the second folded portion 13*b* of the tank 1 and the protrusion portion 15 is provided inside the second folded portion 14*b* of the base plate 2. However, a connection surface may be provided in the first folded portion 13*a* of the tank 1 and the protrusion portion 15 may be provided at a position of the first folded portion 14*a* of the base plate 2 to be opposite to the connection surface. In this case, the ribs 16 formed in the second folded portion 14*b* of the base plate 2 may be formed in the first folded portion 14*a* of the base plate 2.

The present invention is not limited to a heater core for a heater and can be used widely in a heat exchanger for an automotive radiator or the like.

Such changes and modifications are to be understood as being within the scope of the present invention as defined by the appended claims.

What is claimed is:

1. A heat exchanger comprising:

a box-shaped tank having an opening, said tank including folded portions connected to each other to form a connection portion;

a box-shaped base plate connected to said tank to cover said opening of said tank, said base plate including folded portions being connected to said folded portions of said tank and a bottom portion having a hold therein;

a tube inserted into said hold of said base plate and connected to said base plate to communicate with said tank; and a protrusion protruding from an inner surface of said base plate, wherein said connection portion has a clearance between said folded portion of said tank at a folded corner and said protrusion is inserted into said clearance of said connection portion when said base plate is connected to said tank to fill said clearance.

2. A heat exchanger according to claim 1, wherein each of said tank and said base plate is made from an unfolded metal plate by folding.

3. A heat exchanger according to claim 2, wherein said unfolded metal plate includes:

a rectangular body portion having a pair of first sides and a pair of second sides, a length of each first side being larger than that of each second side;

a pair of first folded portions formed along said first sides of said body portion;

a pair of second folded portions formed along said second sides of said body portion, wherein said first and second folded portions are folded and connected to each other to form a box shape.

4. A heat exchanger according to claim 3, wherein said folded portion of said unfolded metal plate has a connection surface connecting between said tank and said base plate.

5. A heat exchanger according to claim 4, wherein said connection surface is provided at said second folded portion of said unfolded metal plate for said tank.

6. A heat exchanger according to claim 3, wherein said protrusion is provided at said second folded portion of said unfolded metal plate for said base plate.

7. A heat exchanger according to claim 3, further comprising:

an insert plate for holding said tube; and a claw portion for receiving said insert plate therein, wherein said claw portion is provided on said second folded portion of said unfolded metal plate for said base plate.

8. A heat exchanger according to claim 3, wherein said second folded portion of said unfolded metal plate for said base plate has a rib for increasing rigidity of said base plate in a longitudinal direction thereof.

9. A heat exchanger according to claim 7, wherein said claw portion has a concave portion.

10. A heat exchanger according to claim 3, wherein:

said connection portion of said tank is formed by folding said first and second folded portions for said tanks;

said clearance is formed between said first and second folded portions;

said protrusion protrudes from said second folded portion for said base plate; and said protrusion of said second folded portion of said base plate is inserted into said clearance between said first and second folded portions of said tank, when said base plate is connected to said tank.

11. A heat exchanger comprising:

a box-shaped tank having a first side portion, a second side portion and an end portion, said end portion being disposed between said first and second side portions;

a box-shaped base plate connected to said tank, said base plate having a first side portion, a second side portion, an end portion and a bottom portion having a hole, said first side portion, said second side portion and said end portion of said base plate being connected to said first portion, said second portion and said end portion of said tank, respectively;

a tube inserted into said hole of said base plate and connected to said base plate; and a first protrusion extending from an inner surface of said base plate, said first protrusion being disposed between said first side portion and said end portion of said tank.

12. The heat exchanger according to claim 1, further comprising a second protrusion extending from an inner surface of said base plate, said second protrusion being disposed between said second side portion and said end portion of said tank.

* * * * *